United States Patent [19]

Christensen

[11] 4,449,584

[45] May 22, 1984

[54] INFLATABLE FLOWING HOLE PLUG

[76] Inventor: Byron Christensen, Box 626, Innisfail, Alberta, Canada, T0M 1A0

[21] Appl. No.: 407,580

[22] Filed: Aug. 12, 1982

[51] Int. Cl.[3] ..... E21B 33/127

[52] U.S. Cl. ..... 166/187; 166/192; 277/34; 277/34.6

[58] Field of Search ..... 166/187, 191, 192, 386, 166/387, 122, 147, 148, 101, 116, 127, 135; 277/34, 34.6, 226; 73/46, 49.1

[56] References Cited

U.S. PATENT DOCUMENTS

| | | | |
|---|---|---|---|
| 2,227,729 | 1/1941 | Lynes | 166/147 |
| 2,231,282 | 2/1941 | Norris | 166/148 |
| 2,603,293 | 7/1952 | Lynes | 166/116 |
| 3,130,787 | 4/1964 | Mason | 166/192 |
| 3,182,725 | 5/1965 | Moore | 277/34 |
| 3,765,484 | 10/1973 | Hamby, Jr. et al. | 166/147 |
| 4,349,047 | 9/1982 | Ditts et al. | 166/187 |

FOREIGN PATENT DOCUMENTS

| | | | |
|---|---|---|---|
| 190840 | 2/1967 | U.S.S.R. | 166/187 |
| 392231 | 11/1973 | U.S.S.R. | 166/191 |

*Primary Examiner*—James A. Leppink
*Assistant Examiner*—Hoang C. Dang
*Attorney, Agent, or Firm*—Shlesinger, Arkwright, Garvey & Fado

[57] ABSTRACT

An inflatable flowing hole plug system including two fluid inflatable hole plugs, having an upper and a lower plug, a connector pipe for connecting these plugs and allowing fluid communication between them, a valve system for controlling the inflation of the plugs and an external fluid supply apparatus for inflating the plugs is disclosed.

14 Claims, 3 Drawing Figures

INFLATABLE FLOWING HOLE PLUG

BACKGROUND OF THE INVENTION

Frequently, in the geophysical drilling industry areas of high-pressure water or other high-pressure fluids are encountered. These high-pressure areas must be efficiently sealed to prevent the escape of these fluids to the surface of the ground.

Seal plugs presently in use tend to be difficult to install, expensive to install, and frequently ineffective when installed. Special equipment, special tools, and large expenditures of manpower are necessary to install these plugs presently in use.

A new and unique seal plug system is necessary for use in this industry.

OBJECTS OF THE INVENTION

The primary object of the disclosed invention is to provide an efficient, easy-to-install, inexpensive seal plug system.

A further object of the disclosed invention is to provide a flexible seal plug system so as to pass by obstacles and obstructions encountered in the bore hole.

A further object of the disclosed invention is to provide a seal plug system which may be inserted into the bore hole and lowered by its external fluid supply hose.

A further object of the invention is to provide a seal plug system in which the valve inflation control system is totally enclosed in the plug system.

An additional object of the disclosed invention is to provide a flexible internal fluid delivery system able to accommodate changes in the size of the plugs.

DESCRIPTION OF THE INVENTION

Figure 1B:
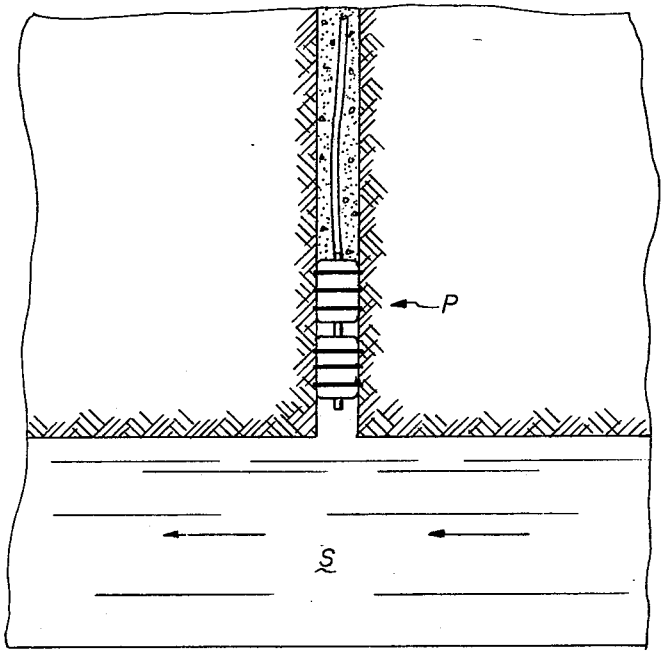
FIG. 1*b* is a fragmentary diagramatic view of an inflated flowing hole plug system in a bore hole.
Figure 1A:
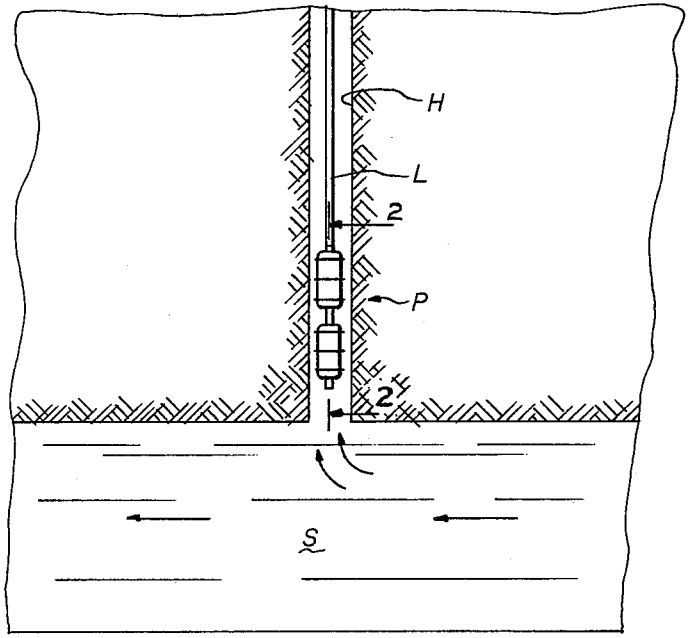
FIG. 1*a* is a fragmentary diagramatic view of an un-inflated flowing hole plug system in a bore hole.

The plug system P is shown in FIGS. 1*a* and 1*b* positioned in a bore hole H in a geophysical area having an underground stream S. A fluid supply line L supplies fluid to the system P from above ground.

Figure 2:
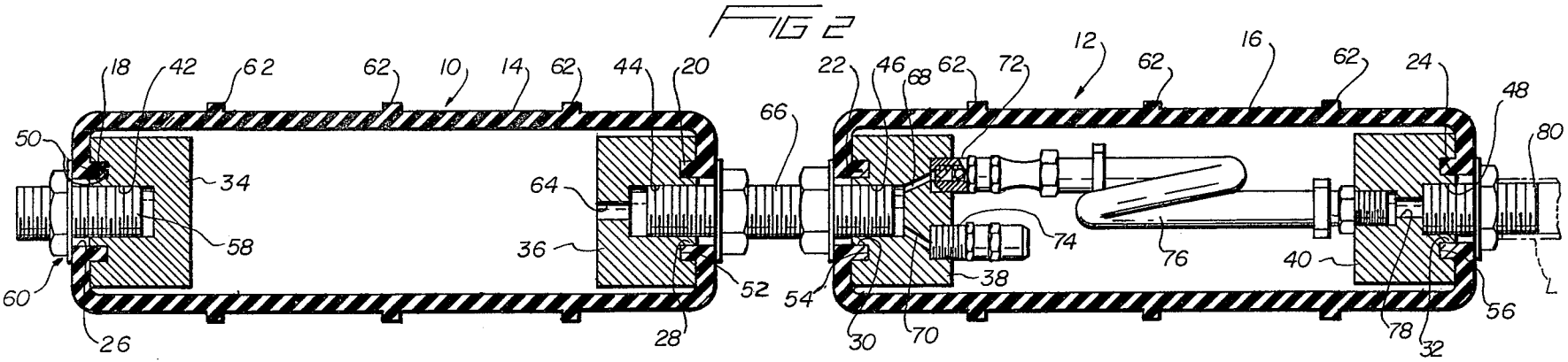
FIG. 2 is a cross-section view of the flowing hole plug system.

Referring now to FIG. 2, the system P includes the lower hole plug 10 and the upper plug 12. It is seen that both plugs 10 and 12 are cylindrical in shape and that the length of the cylinder exceeds its diameter. Both plugs 10 and 12 include flexible and inflatable housings 14 and 16, which are closed at each end by an inverted flange or sealing lip 18, 20, 22 and 24. Through the longitudinal center of each of inverted flanges 18, 20, 22 and 24 are orifices.

Both plugs 10 and 12 are manufactured from a flexible, resilient, rubber-type material. The material is impervious to attack by oil and gas and flexible at either temperature extreme, and in practice the metal components of the plugs will oxidize before the rubber-type material is affected by subsurface gases.

Each of the plugs 10 and 12 include closure caps 34, 36, 38 and 40 which are cylindrical in shape and have their outside diameters corresponding to the inside diameter of their respective hole plug 10 and 12. Located in the longitudinal centers of the closure caps 34, 36, 38 and 40 are threaded bores 42, 44, 46 and 48 extending partially into the closure cap 34, 36, 38 and 40. Circumferentially located about the bores 42, 44, 46 and 48 and aligned with the inward sealing lips 18, 20, 22 and 24 are cap sealing grooves 50, 52, 54 and 56. These cap sealing grooves 50, 52, 54 and 56 accept with and seal with the inward sealing lip 18, 20, 22 and 24. The closure caps 34, 36, 38 and 40 are manufactured of a metal or other suitable material. The weight of the closure caps 34, 36, 38 and 40 tends to help overcome the natural buoyancy of the inflatable flowing hole plug system P.

Threaded into the closure cap 34 is a solid, threaded locking pipe 58. This locking pipe 58 extends into the bore 42 of the closure cap 34. Surrounding the locking pipe 58 in a washer and nut tightening assembly 60. This assembly 60 is tightened to seal the inward sealing lip 18 against the cap sealing groove 50 to thereby prevent leakage of fluid into or out of the plug 10.

Circumferentially around each of the plugs 10 and 12 are a number of external sealing ribs 62. Three ribs 62 are provided for each plug, although a greater or fewer number may be used. These ribs 62 extend into and make contact with the surrounding strata when the plugs 10 and 12 are inflated. In this way the plug system P becomes an integral part of the surrounding strata and a positive mechanical seal is attained.

At the upper end of the lower plug 10 is a cylindrical closure cap 36. This cap 36 has a threaded bore 44 extending longitudinally through its center starting at the outside of the lower plug 10. The threaded bore 44 extends partially through the closure cap 36 and a smaller bore 64 extends through the rest of the closure cap 36. In this way, a means for supplying fluid to the plug 10 is provided.

A hollow, threaded central connector pipe 66 extends partially into the threaded bore 44. Surrounding the central connector pipe 66 is a washer and nut tightening assembly 60 for sealing the inward sealing lip 20 with the cap sealing groove 52 of the closure cap 36. This inward sealing lip 20 and cap sealing groove 52 are similar to those of the lower closure cap 34. The washer and nut tightening assembly 60 is tightened to prevent the entrance or escape of fluid.

At the lower end of the upper plug 12 is a similar inward sealing lip 22. A lower closure cap 38 seals with the sealing lip 22. A threaded longitudinal bore 46 extends partially through the closure cap 38. Two small additional cores 68 and 70 are tapped into the closure cap 38 and meet with the threaded bore 46 and so allow fluid communication.

The central connector pipe 66 is threaded into the closure cap 38 and thereby connects the two plugs 10 and 12. A washer and nut tightening assembly 60 is provided and thereby the two plugs 10 and 12 are in fluid communication with each other through the central connector pipe 66.

Two ball check valves 72 and 74, the upper one of which is shown in detail broken away in FIG. 2, are provided although other types may be used and are attached to the two internal bores 68 and 70 of the closure cap 38. The lower hole plug 10 fluid inlet valve 72 is connected at the other end to an S-shaped flexible internal fluid inlet hose 76. The S-shape of the hose 76 allows for expansion and contraction longitudinally and laterally along the axis of the plug 12. The upper hole plug 12 inlet valve 74 vents into the upper plug 12.

At the upper end of the upper plug 12 is a closure cap 40. This cap 40 has a longitudinal threaded bore 48 through its center extending partially through the cap 40. A smaller bore 78 extends from the threaded bore 48 through the closure cap 40 and is connected to the other end of the internal fluid inlet hose 76. An inward sealing lip 24 and cap sealing groove 56 are provided at the interface of the cap 40. Extending into the threaded bore 48 is a hollow, threaded pipe 80. The pipe 80 is surrounded by a washer and nut tightening assembly 60. The pipe 80 extends beyond the inverted flange 24 of the plug 12. The external fluid supply hose L is connected to the pipe 80 and in this way, the fluid is supplied to whole plug system P.

OPERATION

In operation the flowing hole plug system P is lowered into the bore hole H by the external fluid supply hose L to the proper depth. At that point, fluid delivery is initiated. The lower plug inlet valve 72 is pre-set to allow fluid flow into the lower plug 10 at almost any delivery pressure. The upper plug inlet valve 74 is pre-set for a higher delivery pressure than that of the lower plug inlet valve 72. Consequently, when the lower plug 10 builds up sufficient back pressure, the upper plug 12 inlet valve 74 will open and inflate the upper plug 12. In this way, both plugs 10 and 12 will be inflated, the ribs 62 embedded into the wall of the bore hole, and stress on the plug system P between plugs 10 and 12 will be kept at a minimum. Simultaneous inflation of both plugs as in the prior art reduces plug life. In the event that either plug 10 or 12 should become deflated, the ball check valves 72 and 74 serve to keep the fluid in the remaining plug 10 or 12.

FIG. 1*b* additionally shows the bore hole above the plug system being filled with concrete after inflation. The external fluid hose L, a permanent part of the plug, being left in the bore hole.

While in prior art systems the drill pipe "string" is used to lower a sealing plug to the desired level in information, and pressurized fluid such as air is fed through the "string" to inflate the plug, the system of the present invention, in its preferred form, utilizes to advantage an external hose L attached to the upper end of the upper plug 12. The system therefore, namely the plugs and hose make the subject invention readily portable in that the plugs can be quickly removed from the operator's vehicle, lowered down the bore hole and inflated, without having to assemble any parts. Many flowing holes, as will be appreciated, are surrounded by a small pond created by the subsurface water flowing to the surface and lying in a large pool. Understandably, as each day passes the pool will grow hence making it difficult to drive a fluid unit directly to the site of a flowing hole. With the use of the plug system according to the present invention, the operator needs only to carry the plugs assembly in one hand and a small pressurized air tank in the other. Thus, the operation is greatly simplified.

While this invention has been described as having a preferred design, it will be understood that it is capable of further modification, uses and/or adaptations of the invention following in general the principle of the invention and including such departures from the present disclosure as come within known or customary practice in the art to which the invention pertains, and as may be applied to the essential features hereinbefore set forth, as fall within the scope of the invention or the limits of the appended claims.

What I claim is:

1. A flowing hole plug system, comprising:

(a) two longitudinally and laterally extensible fluid inflatable hole plugs, including an upper plug and a lower plug;

(b) flexible extensible duct means disposed in said upper plug;

(c) first means for connecting said upper plug to a fluid supply line;

(d) second means for connecting said plugs so as to allow fluid communication between said plugs;

(e) said duct means disposed in said upper plug connecting said first and second means; and, (f) valve system means disposed in said upper plug for controlling inflation of said upper and lower plugs.

2. A flowing hole plug system as defined in claim 1, wherein:

(a) said upper and said lower plugs are flexible.

3. A flowing hole plug system as defined in claim 1, wherein:

(a) said valve system means comprises a lower plug inlet valve and an upper plug inlet valve.

4. A flowing hole plug system as defined in claim 3, wherein:

(a) said lower plug inlet valve is pre-set to allow fluid flow to said lower plug at a delivery pressure lower than is that of said upper plug inlet valve to said upper plug.

5. A flowing hole plug system as defined in claim 3, wherein:

(a) means are provided for fluid communication between said upper plug inlet valve and said lower plug inlet valve.

6. A flowing hole plug system as defined in claim 5, wherein:

(a) means are provided to prevent fluid flow from one of said plugs to the other of said plugs and thereby maintain inflation of at least one of said plugs in the event of the deflation of the other of said plugs.

7. A flowing hole plug system as defined in claim 1, wherein:

(a) each of said plugs is of sufficient size and sufficient capacity to seal a bore hole.

8. A flowing hole plug system as defined in claim 1, wherein:

(a) both plugs comprise flexible and inflatable housings, closed at each end by an inverted flange and sealing lip;

(b) closure caps located within each end of each plug, one face of each end cap being grooved to accept said sealing lip;

(c) tightening means adapted to seal said sealing lips against said grooves to prevent leakage of fluid from or to said plugs.

9. A flowing hole plug system as defined in claim 2 or claim 8, wherein:

(a) the external surface of said upper and lower plugs include circumferential sealing rib means.

10. A flowing hole plug system as defined in claim 1 or claim 8 wherein:

(a) pressurized fluid is fed to said plug means by support hose means.

11. A flowing hole plug system as defined in claim 1, wherein:

(a) said flexible extensible duct means including an S-shaped duct for accommodating axial and radial expansion of said plug.

12. A flowing hole plug system as defined in claim 1, wherein:

(a) said second means including a central connector pipe.

13. A flowing hole plug system as defined in claim 1, wherein:

(a) said first means including hollow pipe means threadedly engaging closure cap means.

14. A flowing hole plug system, comprising:

(a) two longitudinally and laterally extensible fluid inflatable hole plugs including an upper plug and a lower plug, each of said plugs including upper and lower ends;

(b) closure cap means disposed within said upper and lower ends of each of said plugs for sealing said plugs;

(c) inlet fluid supply means extending from said upper plug upper end closure cap means for supplying fluid under pressure to said system;

(d) fluid supply means connecting said lower plug upper end closure cap means and said upper plug lower end closure cap means for permitting fluid communication therebetween;

(e) lower plug fluid pressure operable valve means and upper plug fluid pressure operable valve means in fluid communication with said fluid supply means for inflating said lower plug at a fluid supply pressure lower than that associated with inflating of said upper plug; and, (f) flexible extensible fluid duct means disposed in said upper plug connecting said inlet fluid supply means and said lower plug valve means for supplying fluid thereto for selectively inflating said plugs thereby sealing said bore hole whereby each of said lower and upper plug valve means adapted for maintaining its respective plug inflated in the event of deflation of the other of said plugs.

* * * * *